United States Patent [19]

Schubert

[11] 4,247,270

[45] Jan. 27, 1981

[54] APPARATUS FOR THE CONTINUED MANUFACTURE OF STAPLE FIBERS FROM THERMOPLASTIC MATERIALS

[75] Inventor: Günter Schubert, Malsch, Fed. Rep. of Germany

[73] Assignee: IWKA-Industrie-Werke-Karlsruhe Augsburg AG, Fed. Rep. of Germany

[21] Appl. No.: 7,644

[22] Filed: Jan. 29, 1979

Related U.S. Application Data

[62] Division of Ser. No. 876,233, Feb. 9, 1978, abandoned.

[51] Int. Cl.[3] ..... B29D 7/02

[52] U.S. Cl. ..... 425/66; 19/0.56; 28/221; 264/143; 264/151; 264/210.8; 425/142

[58] Field of Search ..... 156/181; 264/146, 143, 264/151, 210.3; 425/66, 142; 28/221; 19/0.56

[56] References Cited

U.S. PATENT DOCUMENTS

| | | | |
|---|---|---|---|
| 2,733,122 | 1/1956 | Herele et al. | 264/103 |
| 3,707,838 | 1/1973 | Dorschner et al. | 264/103 |
| 3,738,884 | 6/1973 | Soehngen | 264/146 |

FOREIGN PATENT DOCUMENTS

| | | | |
|---|---|---|---|
| 2460755 | 1/1976 | Fed. Rep. of Germany | 156/181 |

*Primary Examiner*—Jay H. Woo

*Attorney, Agent, or Firm*—McGlew and Tuttle

[57] ABSTRACT

In the process, the strands, which are spun as a fused mass, are initially drawn, then preferably stretched, crimped or textured, and converted into helical windings. The helical windings are laid down on an endless conveyor formed by two conveyor belts laterally spaced from each other. The laid down helical winding turns are then cut between the two endless conveyors to produce two substantially identical fiber lengths from each helical winding turn. The melt spinning of the strands may be effected at such a high speed that the drawing of the filaments or fibers can be omitted. The helical winding turns, prior to cutting thereof, may be subjected to at least one after-treatment. The apparatus includes a rotary distributor into which the crimped strands are supplied substantially axially for conversion into helical winding turns, and includes endless belts tangentially engaging the helical winding turns to move the same downwardly onto the spaced pair of endless conveyor belts. The apparatus also includes clamping devices for clamping the lateral edges of the laid down helical winding turns prior to and during cutting thereof. The cutting devices are interchangeable, and may include two cutters arranged in series and alternately operative, cutter discs, or a revolving mount having several cutters projecting radially therefrom so that successive cutters may be brought into an operative position in succession.

11 Claims, 5 Drawing Figures

APPARATUS FOR THE CONTINUED MANUFACTURE OF STAPLE FIBERS FROM THERMOPLASTIC MATERIALS

This is a division of application Ser. No. 876,233, filed Feb. 9, 1978, now abandoned.

FIELD AND BACKGROUND OF THE INVENTION

This invention relates to a process and apparatus for the continual manufacture of staple fibers from thermoplastic materials, such as fully synthetic, filament-forming high polymers, polyethyleneterephthalates, or the like, by melt spinning, drawing and cutting in one operating phase at melt spinning speeds exceeding 3,000 m/min.

In presently used processes for the manufacture of staple fibers from thermoplastic polymer filaments, two consecutive processing steps are required. In the first step, the spun filaments are joined to each other to form a cable and the cable is deposited in cans. In the succeeding second step, the cables are withdrawn from groups of cans, are joined together, after-treated, drawn, fixed, crimped, and finally cut. At the present time, spinning speeds range between 1,000 and 4,000 m/min, whereas, drawing speeds range only between 100 and 200 m/min. A combined process is economically feasible only if these spinning speeds can be substantially maintained.

In one of the processes already proposed, namely, that shown in German Offenlegungsschrift No. 2,360,854, filaments, spun at high speed, are drawn by injector nozzle means and blown into an inclined cyclone tube, so that loops are produced. These loops are pulled out of the discharge end of the cyclone tube at a speed which amounts, however, to only one-tenth to one-five-hundredth of the speed at which the filaments are supplied to the cylone tube. Thus, the loops are laid one above the other and produce a cable. This cable is then prepared, as described above, crimped and cut in a continual process.

The proposed process has the drawback that, in accordance with where the loop is cut, filament lengths are produced which in the most unfavorable case amount to the double length of a cut or, in extreme cases, only to a few millimeters. Particularly, excessively long filaments present problems for further processing.

With processes proposed in British Pat. Nos. 824,223 and 796,684, loops are also produced but by inserting rods perpendicular to the moving direction of the approaching filaments. Aside from the fact that, at very high speeds, it becomes difficult to separate the filaments from the rods, in this case also both extremely long and extremely short filaments are produced.

Bearing in mind the disadvantages of the known processes or the proposed processes, the objective of the present invention is to provide a process and apparatus, for the continual manufacture of staple fibers, which avoids both extra long and extremely short filaments.

SUMMARY OF THE INVENTION

In accordance with the invention, this problem is so solved that, initially, the filaments, spun as a fused mass, are drawn, singly or in a group, crimped, and then converted into helical windings with the winding turns being deposited and cut substantially in half so that two approximately identical fiber lengths are produced from each helical winding turn.

In accordance with a development of the invention, a high melt spinning speed is provided so that a filament drawing stage can be omitted.

In accordance with another characteristic of the invention, the filament helical windings are subjected to at least one after-treatment prior to the cutting stage.

The present invenion is directed not only to a process but also to an apparatus for performing the process. Thus, means are provided for subjecting the filaments, which are drawn singly or in groups by stretching rollers or the like, to a crimping process by using a device for high speed texturing and for converting the filaments to helical windings by rotary layer means. After the helical winding turns are deposited onto two divided belt conveyors on which they arrive at a cutting device, their edges are clamped by pressure rollers or the like while the helical turns are engaged by cutters and cut through in the middle. Further features of the apparatus will be apparent from the claims and from the description of the accompanying drawing.

With the invention as so far described, there is the considerable advantage that the helically coiled strand is cut in a longitudinal direction and not a transverse direction, so that extremely long and extremely short fibers are avoided and a uniform type of staple fiber is produced.

An additional advantage of the invention, as compared with known processes, is that it is not a cable which is crimped but rather the individual filaments or groups of filaments are crimped. By virtue of this, and if required, a crimping which is substantially finer scalloped and more uniformly distributed over the capillary filaments is effected.

Aside from a higher jet throughput, for example, higher spinning production and investment cost savings, the method and apparatus of the invention primarily produces savings in personnel and space requirements, because stretching can be omitted. If, based on the tolerable filter load, a further increase in spinneret throughput is impossible then, if so required, the perforation density in the jet and thus any sticking danger can be reduced. Because of reduced space requirements, the process and apparatus of the invention are particularly suitable for transferring the manufacture of staple fibers to wool or cotton spinning mills, for in such cases, it is no problem to plan small scale installations using a modular design. The cut-up filament layers can then be directly received, for example, through pneumatic means, by the flock mixer installation. Thus, formation of a bale in a baling press and the necessity of disintegrating the bale in an opener stage, then becomes superfluous.

An object of the invention is to provide an improved process for the continual manufacture of staple fibers from thermoplastic materials.

Another object of the invention is to provide an improved apparatus for the continual manufacture of staple fibers from thermoplastic materials.

A further object of the invention is to provide such a process and apparatus, for the continual manufacture of staple fibers, which avoids the production of both super-long and extremely short filaments.

For an understanding of the principles of the invention, reference is made to the following description of typical embodiments thereof as illustrated in the accompanying drawing.

DESCRIPTION OF THE PREFERRED EMBODIMENTS

Figures 1, 2, 3, 4, 5:
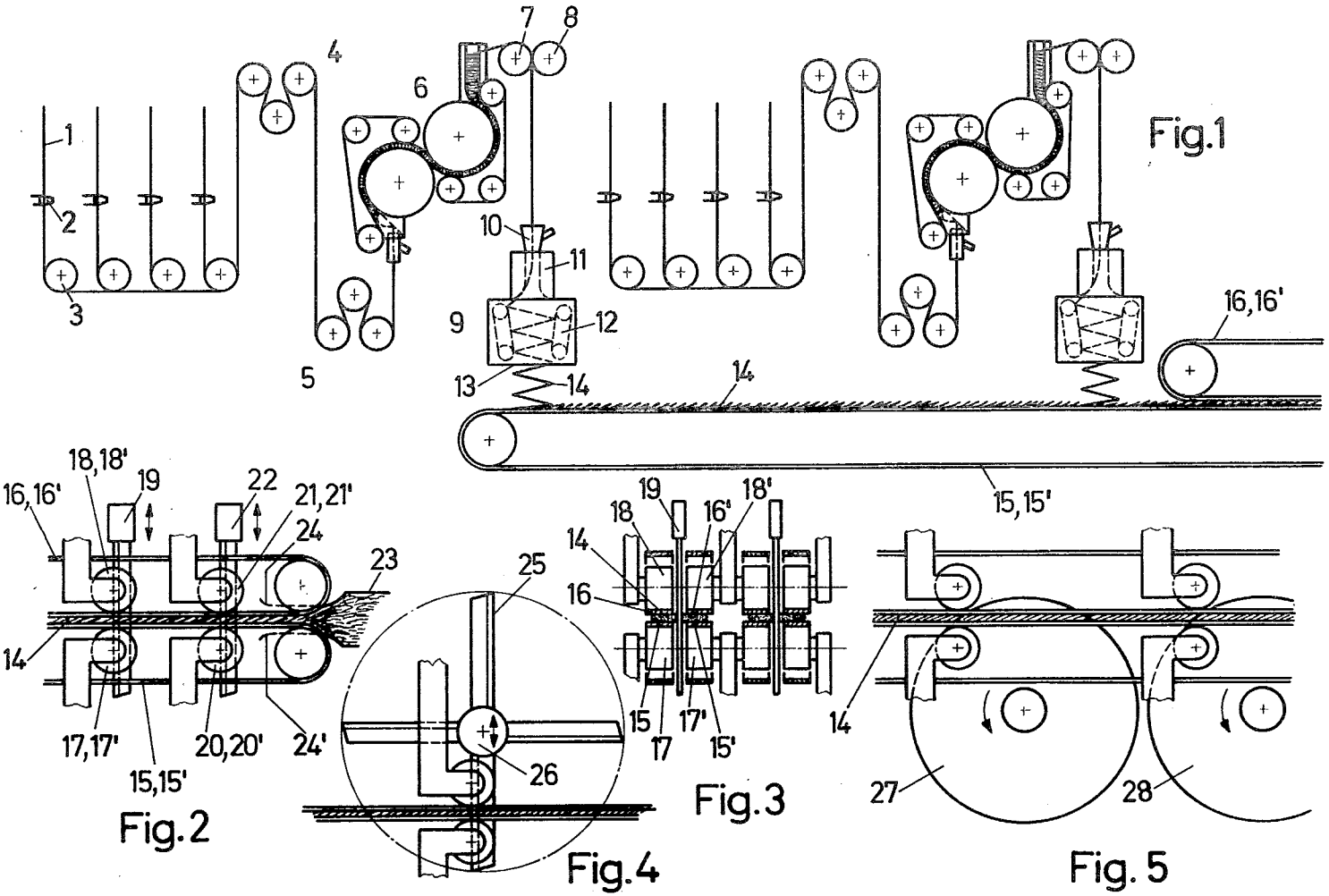
FIG. 1 is a schematic elevation view of apparatus embodying the invention.
FIG. 2 is a side elevation view of a cutter device usable with the apparatus of FIG. 1.
FIG. 3 is a transverse sectional view through the cutter device shown in FIG. 2.
FIG. 4 is a side elevation view of another embodiment of the cutter device.
FIG. 5 is a side elevation view of yet another embodiment of the cutter device.

Referring to FIG. 1, by way of example, two sets of four filaments 1, discharged from respective spinnerets, are provided with spinning preparations by preparation filament guides 2, and are guided around deflection rollers 3 and are fed to a stretching device in adjacent parallel relation to each other. It is also possible to arrange four or eight spinnerets in a circle in approximately the manner disclosed in German Offenlegungsschrift No. 2,453,816. Furthermore, instead of four individual spinnerets, in applicable cases, one large-scale spinneret can be used.

Stretching preferably is effected between two three-roll sets 4 and 5. It will be apparent that, for the residual stretching of rapid-spun filaments, only a relatively narrow total looping angle over the rolls is required, so that three-roll sets, and possible even two-roll sets, generally are sufficient. Also, rapid-spun filaments can be cold-stretched. Although, with polyester silks, generally referred to as "PES," the extent of shrinking is very high, with a texturing stage subsequent to the stretching stage, the PES-filaments are deshrunk. However, the filaments can also be hot-stretched or thermally relaxed. Then, with very high spinning speeds, stretching can be completely omitted. In this latter case, the deflection rolls 3 assure a uniform filament draw-off. This results in a distinct qualitative improvement relative to an already proposed process, where the filaments are pulled off and stretched only by injector spinnerets.

Following the strecthing stage, the filaments are fed to a high speed texturing device 6. For this purpose, for example, a compression-type texturing device can be used. However, steamjet, gear belt, and other known and suitable high-speed texturing devices also can be used in the invention process and apparatus.

In any particular instance of spinning bi-component or other yarns, the crimping device is completely superfluous or may be replaced by a shrinking device. With long-staple fibers, for example, worsted yarn types, the four filaments grouped together are combined ahead of the texturing stage and textured together. Subsequently, they can be deposited together, also in a helically wound manner. On depositing short-staple types, for example, cotton types, very narrow windings must be produced. The total denier, therefor, should not become excessive. For this reason, requirements may call for texturing each individual one of the four filaments. In such a case, a four-fold texturing device, having four adjacent texturing chambers, is used. This is applicable also to long-staple fiber cases, where a very fine-scalloped crimping is required.

From the crimping device 6, the filaments are delivered to a rotary deposit device, generally indicated at 9, through the medium of smooth or geared rolls 7, 8. These rolls, in any given case, can be omitted, for example, a space reduced development of a cable deposit device, already proposed in a different context, can be used. Also, other suitable types of rotary depositors can be utilized. According to the total denier to be deposited and the desired staple length, applicable single or four-fold rotary depositors can be used.

The rotary depositor 9 shown in FIG. 1 substantially comprises a charging hopper 10 having a suction jet and a cutter device for feeding in filaments, a rotary depositor 11 for producing helical windings, as well as a downwardly directing conveyor device 13 comprising several, downwardly running conveyor belts 12 for stabilizing and uniformly depositing the helical windings.

The magnitude of the windings and thus of the fiber staple length is given by the relationship $$d=(v\cdot\cos\alpha)/(\pi\cdot n)$$

where:

d= the winding diameter, v= the speed of the fed filament, $\alpha$= the helix angle (as a function of the speed of the downward conveyor device), and n= the angular velocity of the rotary depositor.

Two fiber bundles are produced for each winding. The staple length can be varied by controlling the angular velocity of the rotary depositor. In each case, the downward conveyor device 13 must be adapted to the winding diameter, for example, by a coordinated timing of the speed of belts 12. Theoretically, it is feasible to set any desired staple-length distribution by a programmed variation in and/or control of the angular velocity.

Helical turns 14 are moved on a conveyor device consisting of two parallel endless conveyor belts 15 and 15', shown more particularly in FIG. 3, which deliver the windings to the cutter stage. In advance of the cutter stage, and if required, after-treatment chambers, for example, for the deshrinking of bi-component filaments or the fixing of textured filaments, can be provided. Just before reaching the cutter device, the edges of the helical windings 14 are clamped by belts 16 and 16' engaging these edges from above.

An exemplified embodiment of a cutter device is shown in FIGS. 2 and 3. As will be clear from FIG. 2, the cutter device is a dual-cutter type, for both winding bands, each consisting of four filaments. If eight filaments are to be individually deposited then, accordingly, an eight-fold cutter device is required, and this can also be a two-level design.

Directly at their interface, the belts 15 and 16 and/or 15' and 16' are pressed together under high-load pressure by rollers 17 and 18 and/or 17' and 18', so that the winding edges are solidly or firmly clamped. The pressing belts or rollers are so supported that a free gap is provided between the respective pairs of bands 15, 16 and 15', 16'. A knife 19 extends into this gap and cuts through the windings. To increase the knife-edge life, the winding heights can be interchanged or adjusted.

Because the invention process and apparatus is a continual process, a flying type of cutter exchange is required. For this purpose, an interface consisting of pressure rollers 20 and 20', 21 and 21', and an interface consisting of a knife 22 are additionally provided. For practical reasons, the two interfaces are arranged in series and are used in alternation. Before removing a used knife for re-grinding, a new unused knife is inserted in the gap. By virtue of this, a continual cutting operation is assured.

At the end of the pressing belt assemblies, a pneumatic extraction line 23 is located. The end of the extraction tube is so arranged that two plates 24 and 24', effective as lifters, extend into the gap between the belts and prevent the cut-up windings from sticking to the run-apart windings.

FIG. 4 illustrates another embodiment of a cutter device, in which the knives 25 are arranged on a revolving or rotating head 26. For boosting the knife-edge life equally, the rotating mount 26 can be constructed for stepwise rotation. Because unengaged knives are exchanged, no second interface is absolutely necessary with the arrangement of FIG. 4.

FIG. 5 illustrates a cutting arrangement where, instead of stationary knives, high-speed rotating cutting discs 27 and 28 are used. This design preferably is used if the cutter speeds of stationary and/or slowly interchanging knives are not sufficient. High cutter speeds also can be obtained by a rapid interchange of knives 19 and/or 22. Furthermore, other cutter means, for example, cutter bands, hot knives or wires, or even laser beams could be used.

While specific embodiments of the invention have been shown and described in detail to illustrate the application of the principles of the invention, it should be understood that the invention may be embodied otherwise without departing from such principles.

What is claimed is:

1. In an apparatus for the continual manufacture of staple filaments from thermoplastic materials including fully synthetic, filament-forming high polymers, polyethyleneterephthalates and the like, by melt spinning, drawing and cutting in one single operating phase at melt-spinning speeds exceeding 3,000 m/min, the improvement comprising, in combination, stretching roller means operable to draw the filaments, spun as a fused mass; a high-speed texturing device receiving the drawn filaments and subjecting the drawn filaments to a crimping process; a rotary distributor means receiving the crimped filaments from said texturing device and converting the crimped filaments into helical windings; a pair of closely adjacent but laterally spaced conveyor belts receiving the helical winding turns from said rotary distributor means; a cutter device operable, in the lateral space between the two conveyor belts, to cut the helical winding turns longitudinally in half; and pressure roller means operable to clamp the edges of the helical winding turns on the conveyor belts before and during cutting of the helical winding turns.

2. Apparatus, as claimed in claim 1, in which said stretching roller means comprises two three-roller sets.

3. Apparatus, as claimed in claim 1, comprising a shrinking device receiving the drawn filaments from said stretching roller means and delivering the drawn filaments to said rotary distributor means.

4. Apparatus, as claimed in claim 1, including at least one after-treatment chamber surrounding said conveyor belts.

5. Apparatus, as claimed in claim 1, in which said rotary distributor means comprises a rotary body serving to form helical filament windings; and a downwardly directed conveyor device engaging the helical windings leaving said rotary body.

6. Apparatus, as claimed in claim 5, in which the angular velocity of said rotary body is adjustable.

7. Apparatus, as claimed in claim 1, in which said cutter device comprises interchangeable cutter means.

8. Apparatus, as claimed in claim 7, in which said cutter device comprises at least two cutter means arranged in series and selectively placeable in operative position to provide for exchange of said cutter means.

9. Apparatus, as claimed in claim 7, in which said cutter means comprise cutter discs rotatabe at high speed.

10. Apparatus, as claimed in claim 7, in which said cutter means comprises plural knives arranged, in angularly spaced relation, on a rotatable support for selective movement of said knives consecutively into operative relation with the helical winding turns.

11. In an apparatus for the continual manufacture of staple filaments from thermoplastic materials including fully synthetic, filament-forming high polymers, polyethyleneterephthalates and the like, by melt spinning, drawing and cutting in one single operating phase at melt-spinning speeds exceeding 3,000 m/min, the improvement comprising, in combination, stretching roller means to draw a plurality of the filaments in adjacent parallel relation to each other, spun as a fused mass; a high-speed texturing device receiving the drawn filaments and subjecting the drawn filaments to a crimping process; a rotary distributor means receiving the crimped filaments from said texturing device and converting the crimped filaments into helical windings; a shrinking device receiving the drawn filaments from said stretching roller means and delivering the drawn filaments to said rotary distributor means; a pair of closely adjacent but laterally spaced conveyor belts receiving the helical winding turns from said rotary distributor means; a cutter device operable, in the lateral space between the two conveyor belts, to cut the helical winding turns longitudinally in half; and pressure roller means operable to clamp the edges of the helical winding turns on the conveyor belts before and during cutting of the helical winding turns.

* * * * *